US011565857B2

(12) United States Patent
Painchaud

(10) Patent No.: US 11,565,857 B2
(45) **Date of Patent: *Jan. 31, 2023**

(54) LIQUID DISPENSING NOZZLE AND DEVICE COMPRISING A CAP

(71) Applicant: Nemera La Verpillière, La Verpilliere (FR)

(72) Inventor: Gaëtan Painchaud, Francheville (FR)

(73) Assignee: Nemera La Verpillière

( * ) Notice: Subject to any disclaimer, the term of this patent is extended or adjusted under 35 U.S.C. 154(b) by 0 days.

This patent is subject to a terminal disclaimer.

(21) Appl. No.: 17/732,142

(22) Filed: Apr. 28, 2022

(65) Prior Publication Data

US 2022/0250812 A1 Aug. 11, 2022

Related U.S. Application Data

(63) Continuation of application No. 16/618,650, filed as application No. PCT/FR2018/051248 on May 30, 2018, now Pat. No. 11,319,121.

(30) Foreign Application Priority Data

May 31, 2017 (FR) ..... 1754835

(51) Int. Cl.
*B65D 47/18* (2006.01)
*B65D 50/04* (2006.01)

(52) U.S. Cl.
CPC ..... *B65D 47/18* (2013.01); *B65D 50/041* (2013.01); *B65D 2215/02* (2013.01)

(58) Field of Classification Search
CPC ..... B65D 47/18; B65D 50/041; B65D 50/06; B65D 2215/02; B65D 50/068
USPC ..... 215/220
See application file for complete search history.

(56) References Cited

U.S. PATENT DOCUMENTS

2004/0262251 A1 12/2004 Tauber
2016/0167838 A1* 6/2016 Dong ..... B65D 41/04 220/255

FOREIGN PATENT DOCUMENTS

FR 2988016 A1 9/2013
WO 2013140069 A1 9/2013
WO 2015140473 A1 9/2015
(Continued)

*Primary Examiner* — Anthony D Stashick
*Assistant Examiner* — Raven Collins
(74) *Attorney, Agent, or Firm* — St. Onge Steward Johnston & Reens LLC

(57) ABSTRACT

A liquid dispensing nozzle includes a liquid dispensing opening and a removable cap configured to cover the liquid dispensing opening. The removable cap includes an outer casing and an inner casing that are coaxial and configured to move relative to each other in an axial direction of the nozzle between an unscrewing configuration wherein a pressing force applied to the removable cap is greater than a predetermined threshold, and a safety configuration wherein a pressing force applied to the cap is lower than the predetermined threshold, wherein the outer casing is configured to freewheel relative the inner casing in the first direction. A rotation of the outer casing in a first direction drives by friction a rotation of the inner casing in the same first direction to unscrew the cap, wherein the pressing force is different from a force required to rotate the cap in the first direction.

17 Claims, 3 Drawing Sheets

(56) References Cited

FOREIGN PATENT DOCUMENTS

WO 2016204732 A1 12/2016

* cited by examiner

LIQUID DISPENSING NOZZLE AND DEVICE COMPRISING A CAP

FIELD OF THE INVENTION

This invention concerns the technical field of liquid dispensing. In particular, but not exclusively, it concerns the field of dispensing liquid in drop or spray form, such as ophthalmic, nasal, buccal or auricular liquid.

BACKGROUND OF THE INVENTION

A liquid dispensing device comprising a container and a dispensing nozzle provided with a removable cap has already been proposed in document WO2013/140069. The cap described in this document comprises two casings mounted so as to be able to move relative to each other in order to create an air passage allowing the residual liquid present in the dispensing opening to evaporate. This cap is opened by simply unscrewing it, so that the liquid product contained in the container becomes easy to access via the dispensing nozzle. This is dangerous for a young child who, when handling the device, could manage to open the cap and access the liquid product, which could cause an intoxication.

The main objective of the invention is to overcome these disadvantages by providing a nozzle and a liquid dispensing device offering improved safety.

The invention therefore relates to a liquid dispensing nozzle comprising:

- a liquid dispensing opening,
- a removable cap intended to cover the opening when it is mounted on the nozzle, the cap comprising an outer casing and an inner casing that are coaxial, mounted so as to be able to move relative to each other in an axial direction (A) of the nozzle between:
- a configuration prior to first use, referred to as the storage configuration, in which the outer casing and the inner casing each have a sealing surface and the sealing surfaces are in hermetic contact with each other;
- an unscrewing configuration of the cap when a pressing force applied to the cap is greater than a predetermined threshold, in which a rotation in a first direction of the outer casing drives by friction a rotation of the inner casing in the same first direction, so as to be able to unscrew the cap;
- a safety configuration when a pressing force applied to the cap is weaker than the predetermined threshold or when no force is applied to the cap, in which the outer casing is configured to freewheel relative to the inner casing in the first direction, the safety configuration further corresponding to a configuration in which the respective sealing surfaces of the outer casing and the inner casing are separated from each other so as to allow air to pass between them.

SUMMARY OF THE INVENTION

Thus, a nozzle is proposed in which the outer casing and the inner casing may advantageously take a configuration allowing air to pass between them, while offering improved safety. In fact, a sufficiently large pressing force must be applied to the outer casing to unscrew the cap. Unscrewing remains simple and intuitive for an adult whereas a child, who is not capable of turning while pressing or pressing hard enough on the outer casing, will only remain in the safety configuration of the cap and will not be able to unscrew it. Preferably, but not exclusively, said pressing force applied to the cap is an axial pressing force. Furthermore, when the cap is in the unscrewing configuration, the outer casing is driven in rotation in the first direction, which is preferably the anticlockwise direction, corresponding to the traditional unscrewing direction. Under the pressing force applied to the outer casing, the inner casing is also driven by friction to turn in the same direction, allowing the cap to be unscrewed. We understand that the arrangement of the sealing surfaces provides a hermetic nozzle prior to its first use. Thus, evaporation of the liquid contained in the nozzle during storage of the nozzle can be limited. After opening the cap for the first time, in other words when the cap is in a configuration other than the storage configuration, the sealing surfaces are no longer in hermetic contact. Consequently, air is advantageously able to pass between the two surfaces and allow the liquid to evaporate when an evaporation path is created between the inside and the outside of the cap. This prevents liquid from stagnating at the nozzle dispensing opening and therefore the development of bacteria. Note that the sealing surfaces are no longer in hermetic contact in the safety configuration and also preferably in the unscrewing configuration.

We understand that the arrangement of the sealing surfaces advantageously creates a residual liquid evaporation path, but that this path is not systematically provided on the nozzle. Although the sealing surfaces may be in hermetic contact with each other, they may also be separated from each other so as to allow air to pass between them, the existence of a residual liquid evaporation path may be an optional feature present on the nozzle. A cap of standard shape is therefore provided, which may or may not have this feature, for example depending on whether or not the casings have air passage openings, so as to optimize the method for manufacturing the cap. Preferably, the storage configuration is a configuration in which the outer casing is in a low position relative to the inner casing.

"The outer casing is configured to freewheel relative to the inner casing in the first direction" means that the outer casing can turn freely relative to the inner casing in this direction, without having to rotate with the inner casing. Thus, when the cap is in safety configuration, the outer casing is configured to be driven in rotation by the user in the first direction while the inner casing remains stationary on the dispensing nozzle. In other words, a rotation in the first direction of the outer casing does not cause the inner casing to rotate in the first direction. "Axial direction of the nozzle" is preferably understood to mean the direction defined by a geometrical axis of the nozzle.

The invention may further comprise one or more of the following characteristics, taken alone or in combination.

- The outer casing comprises means for locking in the storage configuration, cooperating with additional locking means carried by the inner casing, so as to block the outer casing in rotation and in translation relative to the inner casing in the storage configuration. These locking means help to keep the sealing surfaces in hermetic contact and avoid any accidental opening of the cap. For example, the outer casing comprises a gadroon received in a retaining housing carried by the inner casing.
- The inner casing is provided with a peripheral and circular groove intended to receive the means for locking in the safety configuration and in the unscrewing configuration, so as to allow these locking means to rotate freely in the peripheral groove. This free rotation is allowed at least in the safety configuration, and possibly in the unscrewing configuration. Advantageously, the groove retains the locking means axially between two stops in order to define two axial positions of the outer casing relative to the inner casing, corresponding to the safety and unscrewing configurations. In other words, the height of this groove corresponds to the axial distance travelled by the locking means when the outer casing moves relative to the inner casing between the safety configuration and the unscrewing configuration.

The outer casing comprises an actuation projection, and the inner casing comprises a guide surface intended to cooperate with the actuation projection so that:

in the safety configuration, a rotation of the outer casing in the first direction causes the actuation projection to slide on the guide surface in order to turn freely relative to the inner casing, in the unscrewing configuration, a rotation of the outer casing in the first direction drives, by friction of the actuation projection on the guide surface, the inner casing in the first direction so as to unscrew the cap.

We understand that the friction corresponds advantageously to a friction force created between the actuation projection and the guide surface when a pressing force applied to the cap is greater than the predetermined threshold, this friction being large enough for the outer casing to drive in rotation the inner casing in the first direction. This friction provides better protection for the nozzle since a sufficiently large pressing force must be applied to the outer casing, in a predetermined direction (in this case, the axial direction of the nozzle). The outer casing must be pressed and rotated simultaneously to unscrew, which represents an obstacle for a child, preventing the child from opening the cap easily.

The guide surface comprises a discontinuous camway, so as to generate a tactile or audible indication when the actuation projection crosses the camway discontinuity in the safety configuration. For example, the inner casing comprises a first skirt of substantially cylindrical shape, the guide surface comprising at least two guide slopes extending from said first skirt in the axial direction and being separated by notches. The user then observes/feels a back and forth movement of the outer casing in the axial direction, indicating that the cap is in the safety configuration and that the outer casing must be pressed to unscrew, for example axially.

The guide surface is carried by a guide slope and the inner casing comprises a flat area substantially normal to the axial direction extending from one end of the guide slope, the end of the flat area opposite the guide slope being provided with a lug forming a hard point. This hard point formed by the lug prevents the outer casing from dropping into the storage configuration, more precisely into the low position relative to the inner casing.

The actuation projection is provided with a screwing stop, cooperating with a complementary screwing stop carried by the inner casing, so that the inner casing and the outer casing are connected in a rotational movement in a second direction opposite to the first direction, in order to screw the cap on the nozzle. Thus, according to this arrangement, the screwing and unscrewing of the cap are activated by the same element of the outer casing, namely the actuation projection, thereby simplifying the manufacturing process and providing a more compact nozzle.

The cap comprises a residual liquid absorption pad, arranged near the liquid dispensing opening. This pad is advantageously arranged downstream from the dispensing opening and is used to drain a large proportion of the residual liquid out of the dispensing opening.

The cap comprises a protuberance intended to be in the immediate vicinity and opposite the opening when the cap is mounted on the nozzle, this protuberance having a residual liquid expulsion shape, configured to evacuate the residual liquid to the outside when the cap is mounted on the nozzle. Due to the presence of the residual liquid expulsion shape created on the removable cap, when the cap is mounted on the nozzle, the expulsion shape located in the immediate vicinity and opposite the liquid dispensing opening expels most of the residual liquid present downstream from the dispensing opening, in particular towards the residual liquid absorption pad, if any, arranged nearby, in other words the residual liquid is evacuated to the outside of the nozzle. Most of the residual liquid is therefore drained out of the dispensing opening.

A residual liquid evaporation path is arranged between the opening and the outside of the nozzle, the residual liquid evaporation path being blocked in the storage configuration and open in the safety configuration. Advantageously, it is also open in the unscrewing configuration. We understand that the residual liquid evaporation path is opened when the respective sealing surfaces of the outer casing and the inner casing are separated from each other so as to allow air to pass between them. Thus, the residual liquid is in contact with the air outside the cap and can evaporate via the evaporation path once the cap is no longer in the storage configuration.

The outer casing is provided with a bottom in which a sealing skirt projects from the inner surface, this sealing skirt carrying the sealing surface of the outer casing and being configured so that, in the storage configuration, the sealing skirt is pressed hermetically against the sealing surface of the inner casing, and so that in the safety configuration, and preferably in the unscrewing configuration, the sealing skirt is separated from the sealing surface of the inner casing. Thus, the sealing skirt of the outer casing and the sealing surface of the inner casing are assembled by insertion to improve the sealing of the cap.

The outer casing can take at least three different axial positions relative to the inner casing, defining a minimum distance in the storage configuration and corresponding to a low position of the outer casing relative to the inner casing, an intermediate distance in the unscrewing configuration and a maximum distance in the safety configuration. The minimum distance corresponds to a distance allowing hermetic contact of the sealing surfaces and the intermediate distance generally corresponds to a distance at which the outer casing is moved away from the inner casing after opening the cap for the first time to create an evaporation path. At this intermediate distance, the outer casing can no longer return to the storage configuration. The maximum distance corresponds in particular to a position in which the outer casing reaches the upper end of the guide surface in the safety configuration. Thus, in the safety configuration, the outer casing moves between the intermediate distance and the safety distance making a back and forth movement in the axial direction of the nozzle, thereby giving a tactile and/or audible indication to the user.

On the outside of the outer casing, the cap is provided with raised or visual means indicating to the user how to move from the safety configuration to the unscrewing configuration. For example, the means may comprise a series of symbols such as arrows, digits, text indicating the order of the actions to be carried out.

The cap comprises means for indicating that the cap is in a configuration other than the storage configuration.

The invention further relates to a liquid dispensing nozzle, comprising:

a liquid dispensing opening, a removable cap intended to cover the opening when it is mounted on the nozzle, the cap comprising an outer casing and an inner casing that are coaxial, mounted so as to be able to move relative to each other in an axial direction of the nozzle between:

a configuration prior to first use, referred to as the storage configuration, an unscrewing configuration of the cap when a pressing force applied to the cap is greater than a predetermined threshold, in which a rotation in a first direction of the outer casing drives by friction a rotation of the inner casing in the same first direction so as to be able to unscrew the cap;

a safety configuration when a pressing force applied to the cap is weaker than the predetermined threshold or when no force is applied to the cap, in which the outer casing is configured to freewheel relative to the inner casing in the first direction, the safety configuration, and preferably the unscrewing configuration, further corresponding to a configuration in which the respective sealing surfaces of the outer casing and the inner casing are separated from each other so as to allow air to pass between them, the outer casing taking at least three different axial positions relative to the inner casing, defining a minimum distance in the storage configuration, an intermediate distance in the unscrewing configuration and a maximum distance in the safety configuration.

This nozzle may be provided with one or more of the characteristics described above, taken alone or in combination.

Lastly, the invention relates to a liquid dispensing device comprising a liquid dispensing nozzle as described above mounted on a container.

BRIEF DESCRIPTION OF THE DRAWINGS

The invention will be better understood on reading the following description, given solely by way of example and by referring to the drawings wherein.

DETAILED DESCRIPTION OF THE INVENTION

Figure 1:
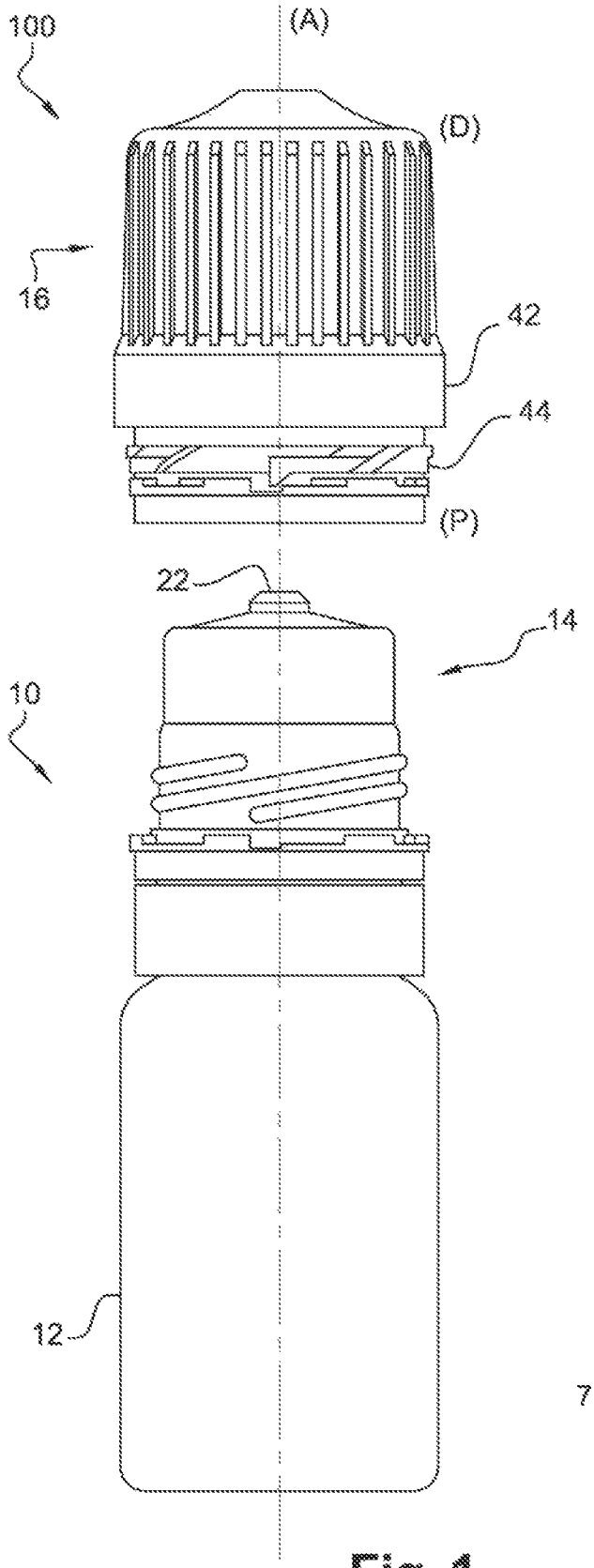
FIG. 1 is a side view of a dispensing device according to one embodiment comprising a dispensing nozzle with the cap removed, the dispensing nozzle being carried by a container.

A device, as shown on FIG. 1 and designated by reference 100, comprises a deformable container 12 which is a storage container for liquids, for example pharmaceutical liquid such as ophthalmic liquid, and a nozzle. The nozzle is a nozzle for dispensing liquid in the form of drops. The nozzle designated by reference 10 comprises a dispensing portion 14 provided with a liquid dispensing opening 22 and intended to be mounted on the neck of the container 12 by clipping, welding or screwing. The nozzle 10 further comprises a removable cap 16 mounted by screwing on the dispensing portion 14 and intended to cover the opening 22 when the nozzle 10 is not used. The cap 16 has a proximal end (P) arranged on the side of the opening of the cap 16 and an opposite distal end (D).

The cap 16 comprises an outer casing 42 and an inner casing 44. These outer and inner casings 42, 44 are coaxial and mounted so as to be able to move relative to each other in an axial direction (A) of the nozzle 10. The axial direction A of the nozzle 10 is defined in this case by the geometrical axis of the container 12. The outer and inner casings 42, 44 can move along this geometrical axis, either by moving away from each other or by moving towards each other. Since they can move, the outer and inner casings 42, 44 can define in particular three different configurations of the nozzle 10, namely a configuration prior to first use, referred to as the storage configuration, a configuration for unscrewing the cap 16 and a safety configuration, which will all be described in detail below.

Figure 2:
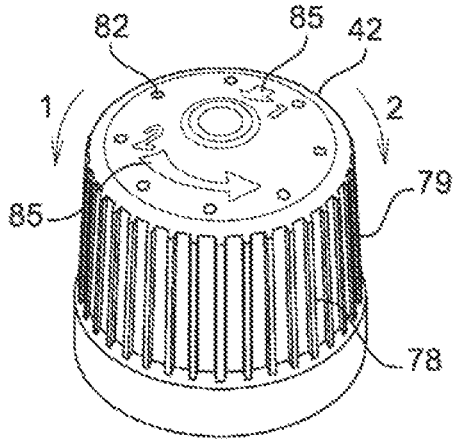
FIG. 2 is a perspective view of the outside of the outer casing of the nozzle of FIG. 1.
Figure 3:
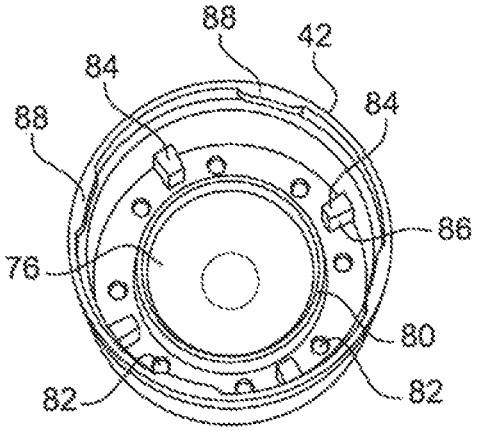
FIG. 3 is a perspective view of the inside of the outer casing of the nozzle of FIG. 1.

As shown on FIGS. 2 and 3, the outer casing 42 comprises a bottom 76 and a peripheral wall 79, of substantially cylindrical shape. The bottom 76 has a circular and substantially conical shape. The outer casing 42 comprises a sealing skirt 80, projecting from the inner surface of the bottom 76, arranged inside and having in this case an annular shape that is coaxial with the peripheral wall 79. In this example also, the bottom 76 comprises air passage openings 82 located on the periphery of the sealing skirt 80. The outer casing 42 further comprises means 88 for locking the nozzle 10 in the storage configuration, arranged at the proximal end (P) of the outer casing 42. The locking means 88 comprise more precisely a plurality of gadroons 88 projecting from the inner surface of the peripheral wall 79. The outer casing 42 also comprises an actuation projection 84 arranged on the inner surface of the outer casing 42 at the distal end (D). The actuation projection 84 consists in this case of a lug 84 projecting both from the bottom 76 and from the peripheral wall 79. The lug 84 comprises more precisely a lower surface, directed towards the proximal end of the cap 16, intended to be in contact with the inner casing 44 by friction in the safety configuration, and a lateral surface 86 forming a screwing stop 86, intended to be in contact with the inner casing 44.

Figure 4:
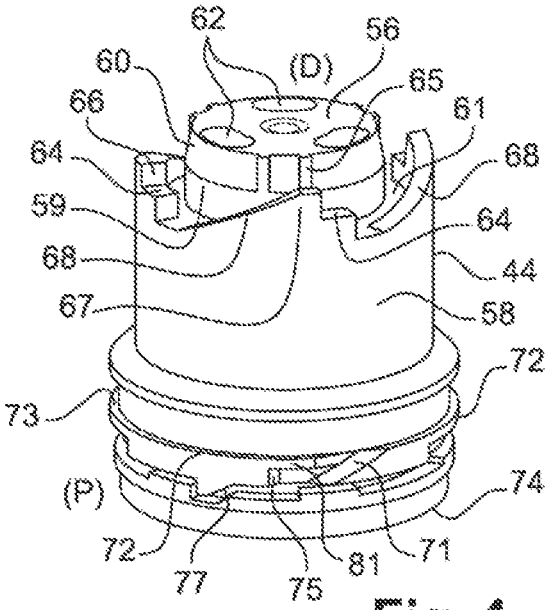
FIG. 4 is a perspective view of the inner casing of the nozzle of FIG. 1.

The inner casing 44, as shown on FIG. 4, comprises a ceiling 56, a first skirt 58 and a second skirt 59 of substantially cylindrical shape connected to each other by a plate 61. The ceiling 56 is defined in this example by a frustoconical surface 60 connecting it to the second skirt 59 and comprises air passage openings 62, three in this example. The inner casing 44 further comprises means 72, 75 for locking the nozzle 10 in the storage configuration, arranged on the side of the proximal end (P) of the cap 16. These locking means 72, 75 are complementary to the locking means 88 carried by the outer casing 42. They comprise more precisely axial retaining stops 72, in this case four, so as to form a stop in the axial direction (A), to retain the outer casing 42 on the inner casing 44 in the axial direction in the storage configuration. The locking means further comprise at least one hard point 75, more precisely four hard points 75, each defining with the axial retaining stop 72, a retaining housing 77 intended to receive the locking means 88 carried by the outer casing 42.

The inner casing 44 further comprises a peripheral and circular groove 73 arranged between the complementary locking means 72, 75 and the distal end (D) of the inner casing 44. This groove 73 is intended to receive the means 88 for locking in the safety configuration and in the unscrewing configuration, so that these locking means 88 can rotate freely in the groove 73. In addition, a camway 71 is arranged between the retaining housing 77 and the groove 73. The camway 71 is separated from the groove 73 by an edge 81. In addition, the inner casing 44 carries on the proximal end (P) a frangible ring 74 of the nozzle 10, acting as first opening indicator, to ensure that the nozzle 10 has not been used prior to its first use.

Lastly, the inner casing 44 comprises four guide slopes 67 extending from the first skirt 58 in the axial direction (A), each guide slope 67 having a guide surface 68 and a screwing stop 66, complementary to the screwing stop 86 carried by the outer casing 42. The guide slopes 67 are separated from each other by an area in which a notch 64 extends from the first skirt 58, forming a step between the complementary screwing stop 66 and the first skirt 58. The notch 64 extends along a plane substantially transverse to the axial direction (A).

We will now describe the mounting and operation of the nozzle 10.

Figure 5A:
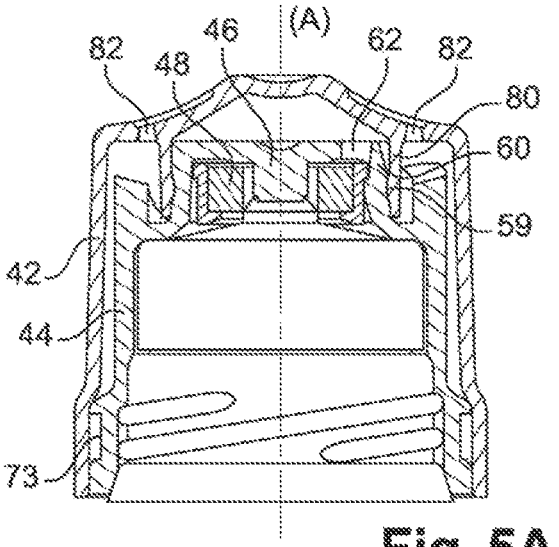
FIG. 5A is a cross-sectional view of the cap of the nozzle of FIG. 1 in the storage configuration.
Figure 5B:
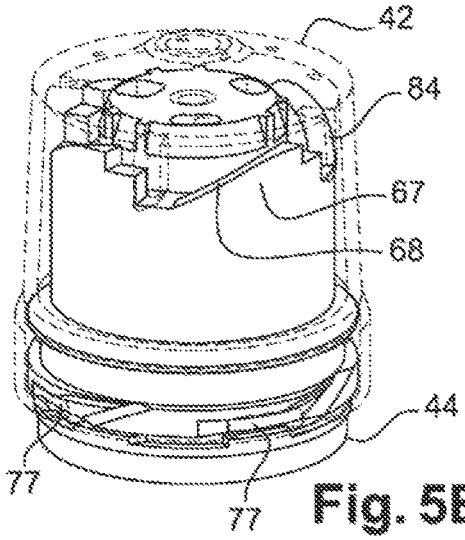
FIG. 5B is a perspective and partially transparent view of the cap of the nozzle of FIG. 1 in the storage configuration.

The outer casing 42 is first mounted on the inner casing 44 by positioning the actuation projections 84 in the area located between a notch 64 and a guide slope 67, as shown on FIG. 5B, such that the gadroons 88 are positioned in the retaining housing 77 and cooperate with the retaining stops 72 so as to prevent the outer casing 42 from translating relative to the inner casing 44. The gadroons 88 also cooperate with the hard points 75 so as to prevent the outer casing 42 from rotating relative to the inner casing 44. Thus, the cap 16 is ready to be mounted by screwing on the dispensing portion 14. Once the container 12 has been filled with the liquid to be dispensed, the nozzle 10, including the cap 16, is mounted on the neck of the container 12, for example by screwing, clipping or any other known technique. The nozzle 10 is ready to be used.

The configuration prior to first use, referred to as the storage configuration of the nozzle 10, is shown on FIGS. 5A and 5B. FIG. 5B shows the outer casing 42 in wire mode to illustrate the interaction between the elements of the inner casing 44 with the elements of the outer casing 42. On these figures, the sealing skirt 80 of the outer casing 42 cooperates with the second skirt 59 of the inner casing 44, so that there is no communication between the air passage openings 62 of the inner casing 44 and the air passage openings 82 of the outer casing 42. The sealing skirt 80 thus carries a sealing surface of the outer casing 42 and the second skirt 59 is itself a sealing surface of the inner casing 44. The sealing skirt 80 presses hermetically against the second skirt 59 so that the sealing surfaces are in hermetic contact with each other in the storage configuration. In this case, the outer casing 42 is in an axial position defining a minimum distance from the inner casing 44, as shown on FIG. 5A.

On first use, the user unscrews the cap 16. The user holds the outer casing 42 in one hand and the container 12 in the other hand. The user turns the outer casing 42 relative to the inner casing 44 in a first direction 1 which corresponds to the anticlockwise direction, shown on FIG. 2. The actuation projections 84 are then guided by the guide slopes 67 and move on the guide surfaces 68. The rotational movement applied by the user to the nozzle 10 generates an axial translation movement of the outer casing 42 relative to the inner casing 44. Due to the longitudinal displacement of the outer casing 42 relative to the inner casing 44, and when not in the storage configuration, the sealing skirt 80 of the outer casing 42 no longer cooperates with the second skirt 59 but is opposite the frustoconical surface 60 of the inner casing 44, such that the respective sealing surfaces of the outer casing 42 and the inner casing 44 are separated from each other and a space is created between them so as to allow air to pass between them.

Figure 6A:
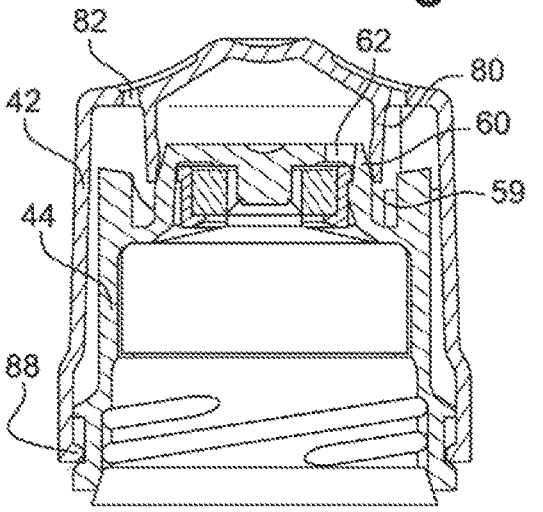
FIG. 6A is a cross-sectional view of the cap of the nozzle of FIG. 1 in the unscrewing configuration.

At the same time, the pressing force applied by the user enables each gadroon 88 (shown on FIG. 3), moving along the camway 71 (shown on FIG. 4), to cross the edge 81 (shown on FIG. 4) to reach the groove 73 (shown on FIG. 4). The crossing of the edge 81 by the gadroon 88 can be made safe by a hard point 75 provided in the camway 71 and preventing the gadroon 88 from circulating freely in the camway 71. The user thus obtains a tactile indication that the cap 16 is open. On reaching the groove 72, the gadroons 88 cooperate with the retaining stops 72 (shown on FIG. 4), in order to keep the outer casing 42 in an axial position defining an intermediate distance from the inner casing 44, as shown on FIG. 6A. The actuation projections 84 (shown on FIG. 3) help to keep the outer casing 42 at the intermediate distance, by cooperating with the notches 64 (shown on FIG. 4). This keeps the sealing surfaces separated from each other so as to allow air to pass between them. The inner casing 44 may advantageously comprise a shape, either a hollow or a protuberance, for example a pin, on the guide surface 68 in order to make it harder for the gadroon 88 to return into the camway. This shape complements the action of the hard point 75 to prevent the outer casing 42 from returning to the storage configuration.

In the example shown, the two outer and inner casings 42, 44 are respectively provided with air passage openings 82, 62 so as to create a residual liquid evaporation path between the opening 22 and the outside of the nozzle 10. The residual liquid evaporation path is blocked in the storage configuration and open in the safety and unscrewing configurations. We could nevertheless have a cap 16 provided with air passage openings only on the inner casing 44 or the outer casing 42, without the possibility of creating an evaporation path.

Figure 6B:
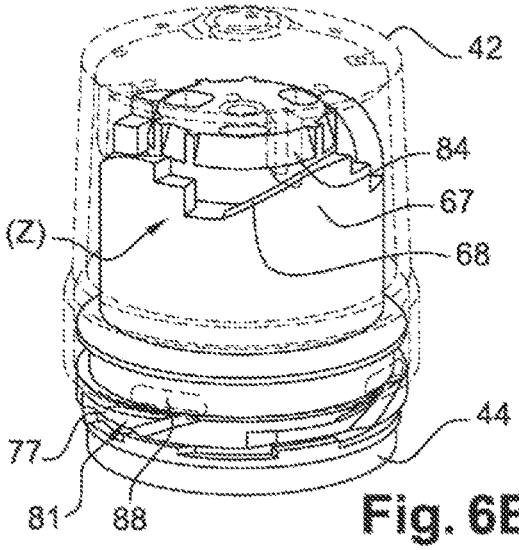
FIG. 6B is a perspective and partially transparent view of the cap of the nozzle of FIG. 1 in the unscrewing configuration.

Once the cap 16 is no longer in the storage configuration, the user, for example an adult, can open the cap 16 by applying a pressing force greater than a predetermined threshold, in this case an axial pressing force. The cap 16 is then placed in the unscrewing configuration, as shown on FIGS. 6A and 6B. In this configuration, by rotating the outer casing 42 in the first direction 1, each actuation projection 84 comes up against a corresponding guide surface 68. The pressing force on the outer casing 42 is then transmitted to the guide surface 68, such that friction is created between the actuation projection 84 and the guide surface 68. This friction holds the actuation projection 84 and the guide surface 68 together so that the outer casing 42 can drive the inner casing 44 in rotation in this first direction 1, without the actuation projection 84 being able to slide on the guide surface 68, or with a sliding movement that generates sufficient friction to drive the inner casing 44 in rotation. The cap 16 is thus unscrewed from the rest of the nozzle 10. Gripping ribs 78 are arranged on the outer periphery of the outer casing 42 so as to facilitate the transmission of the pressing and rotational forces.

In the example shown, in reference to FIG. 2 described above, on the outside of the outer casing 42 the cap 16 is provided, at the bottom 76, with raised or visual means 85 indicating to the user how to move from the safety configuration to the unscrewing configuration. These means comprise a first arrow with the digit 1 indicating that the first step to open the cap 16 is to press the outer casing 42 downwards and a second arrow with the digit 2 indicating that the second step to open the cap 16 is to turn the outer casing 42 in the first direction 1.

As described above, the outer casing 42 is kept at an intermediate distance from the inner casing 44 when the gadroons 88 are in the groove 73, in contact with the lower portion of this groove 73, formed by the retaining stops 72. We understand that when the user continues the rotational movement of the cap 16 relative to the container 12 to unscrew the cap 16 completely from the dispensing portion 14, the frangible parts of the ring 74 break. This ring 74 therefore provides a simple way of checking that the nozzle has not been used previously.

In an especially advantageous embodiment, the cap 16 also comprises a visual means indicating to the user that the storage configuration has been crossed. This means may comprise an identification surface carried by the inner casing 44 and a reference surface carried by the outer casing 42, the reference surface being intended to cover the identification surface only in the storage configuration. The two surfaces each have a different appearance which allows the user to clearly distinguish between the identification surface and the reference surface when the cap 16 is open. The cap 16 according to this embodiment is simpler and less expensive to manufacture. The frangible ring 74 described above could therefore be replaced by the combination of the identification surface and the reference surface. The two embodiments could also be combined so that the indication to the user that the cap 16 is open is simpler and safer.

Figure 7A:
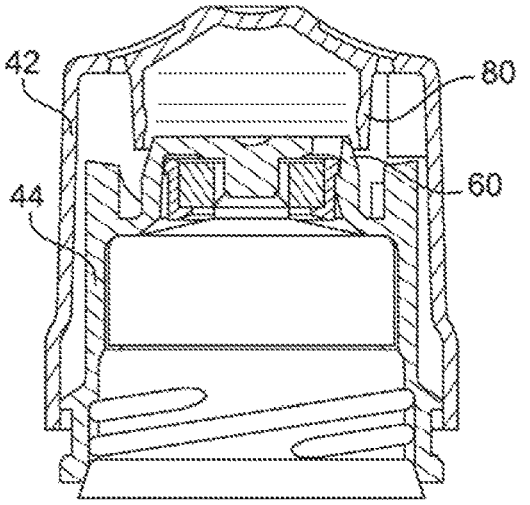
FIG. 7A is a cross-sectional view of the cap of the nozzle of FIG. 1 in the safety configuration.
Figure 7B:
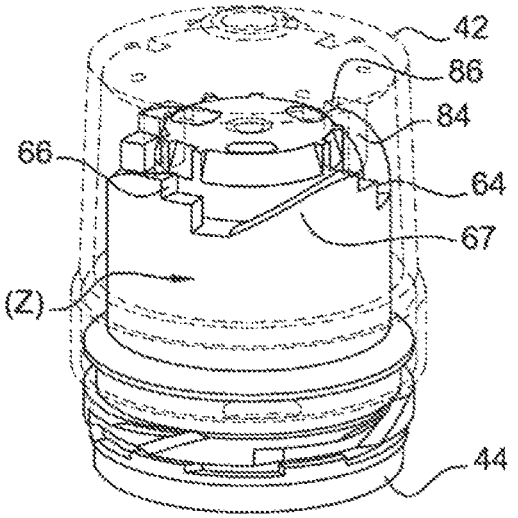
FIG. 7B is a perspective and partially transparent view of the cap of the nozzle of FIG. 1 in the safety configuration.

If the user, for example a child, only turns the outer casing 42 in the first direction 1 without pressing hard enough on the bottom 76, the cap 16 will be in the safety configuration, as shown on FIGS. 7A and 7B. Since the force transmitted to the guide surface 68 is not strong enough to create sufficient friction, the actuation projection 84 moves along the guide slope 67 up to its top, as shown on FIG. 7B. The outer casing 42 is then at a maximum distance from the inner casing 44. The actuation projection then returns to the notch 64 and the outer casing 42 returns to its position defining the intermediate distance from the inner casing 44. Thus, a rotation of the outer casing 42 in the first direction causes the actuation projection 84 to slide successively on each guide surface 68 in order to freewheel relative to the inner casing 44.

In this safety configuration, the actuation projections 84 move intermittently from one guide slope 67 to another. Thus, the guide slopes 67, separated from each other by a notch 64, form a discontinuous camway and the passage of the actuation projection 84 over the camway discontinuity generates a tactile or even audible indication.

Between two uses, the user screws the cap 16 back onto the dispensing portion 14. The outer casing 42 simply has to be turned in a second direction 2, corresponding to the clockwise direction without applying a specific axial pressing force. Each screwing stop 86 carried by the actuation projection 84 then comes up against the complementary screwing stop 66 carried by the inner casing 44. Thus, the two outer and inner casings 42, 44 are connected in a rotational movement in the second direction 2 and the cap 16 can be screwed back on. When screwing the cap back on, the actuation projections 84 press against the notches 64, which prevents the gadroons 88 from forcing on the retaining stops 72 and from returning into the retaining housing 77. We therefore understand that it is possible to move from the storage configuration of the nozzle 10 to the safety or unscrewing configuration but that the opposite is not possible. This therefore guarantees that once the nozzle 10 has been used at least once, the residual liquid evaporation path is always open.

In one embodiment, the cap 16 comprises clearance reduction ribs 65 on the inner casing 44, as shown on FIG. 4. When the outer casing 42 is positioned at the maximum distance from the inner casing 44, the sealing skirt 80 moves to the clearance reduction ribs 65 to limit noises between the parts.

Figure 8A:
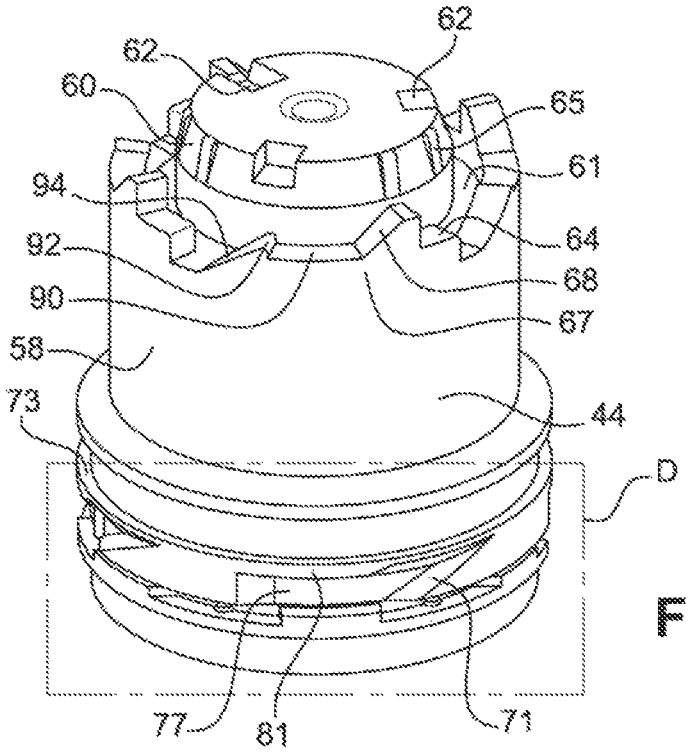
FIG. 8A is a view similar to FIG. 4 of a first alternative of the inner casing of the nozzle.
Figure 8B:
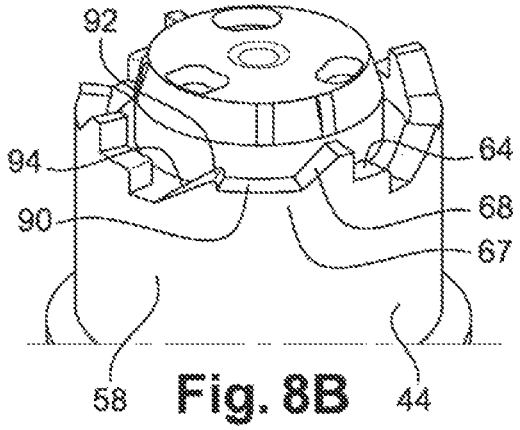
FIG. 8B is a view similar to FIG. 5B of a second alternative of the inner casing of the nozzle.
Figure 8C:
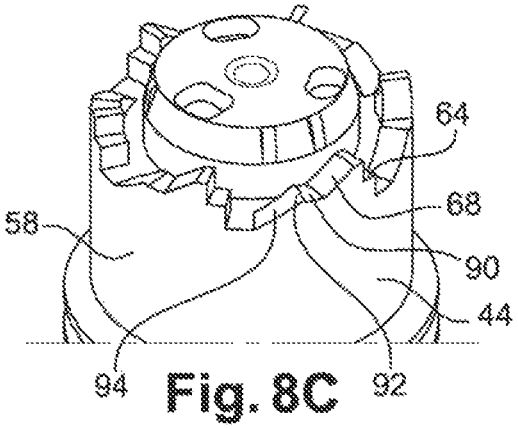
FIG. 8C is a view similar to FIG. 5B of a third alternative of the inner casing of the nozzle.

FIGS. 8A to 8C show alternative embodiments of the inner casing 44 of the nozzle 10. In these alternatives, the guide surface 68 comprises, in addition to the guide slope 67, a flat area 90 extending from the end of the guide slope 67 opposite the notch 64. More precisely on FIG. 8A, the flat area 90 extends to the left from the left end of the guide slope 67. The flat area 90 and the notch 64 preferably extend along the same plane substantially transverse to the axial direction (A). We understand that the plane in which the flat area 90 extends is preferably substantially normal to the axial direction (A). The end of the flat area 90 opposite the guide slope 67 is provided with a lug 92 forming a hard point. This hard point formed by the lug 92 prevents the outer casing 42 from dropping into the low position relative to the inner casing 44 corresponding to the storage configuration.

The lug 92 extends, in a direction opposite to the flat area 90 (to the left on FIG. 8A), by a second guide slope 94. Preferably, the second guide slope 94 forms an angle with the surface along which the flat area 90 extends (in this case with a plane substantially normal to the axial direction (A)) substantially identical to the angle formed by the first guide slope 67 with the surface along which the flat area 90 extends (in this case with a plane substantially normal to the axial direction (A)).

In the alternatives shown on FIGS. 8A to 8C, the guide slope 67 forms an angle of at least 20° with the plane normal to the axial direction (A) in which the flat area 90 or the notch 64 extends. More precisely, in the alternative shown on FIG. 8A, this angle is substantially equal to 28°. In the alternative shown on FIG. 8B, this angle is substantially equal to 45°. In the alternative shown on FIG. 8C, this angle is substantially equal to 55°. A guide slope 67 with a large inclination allows easier opening, since the user does not have to press hard to start rotating the outer casing 42 on the inner casing 44. In the alternative shown on FIG. 8C, the flat area 90 extends over a more restricted sector of the skirt 58.

Figure 9:
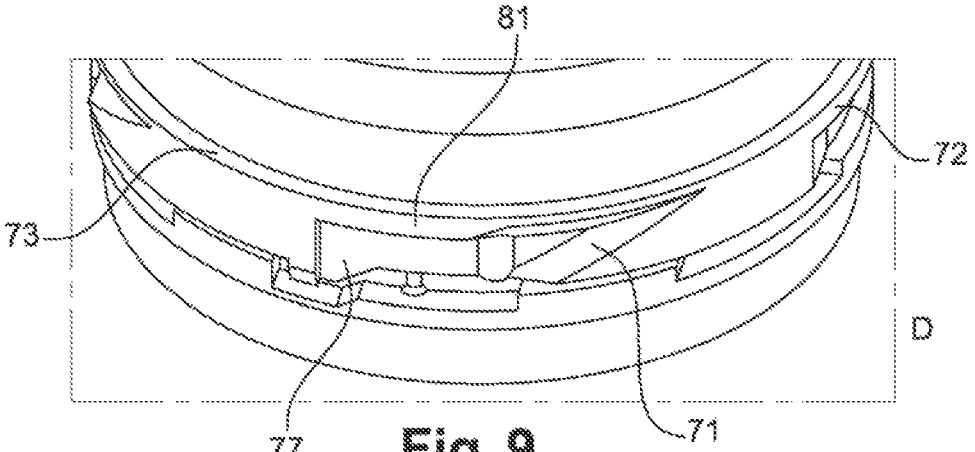
FIG. 9 is a view of a detail D of FIG. 8A.

In addition, as can be seen in detail on FIG. 9, in the alternatives shown on FIGS. 8A to 8C, the camway 71 arranged between the retaining housing 77 and the groove 73 is defined by the edge 81 of the groove 73 around the entire periphery of the inner casing 44. This prevents the outer casing 42 from returning to the low position relative to the inner casing 44 when closing the cap 16, even if a large pressing force is applied (by "forcing"). Obviously, we understand that this alternative of the camway can be adapted to the embodiments of all the figures and that the camway 71 of FIGS. 4 to 7B can be adapted to that of FIGS. 8A to 9.

In one embodiment, as shown for example on FIG. 5A, the cap 16 comprises a protuberance intended to be in the immediate vicinity and opposite the opening 22 when the cap 16 is mounted on the nozzle 10, this protuberance having a residual liquid expulsion shape 46, configured to evacuate the residual liquid to the outside when the cap 16 is mounted on the nozzle 10. If a residual liquid evaporation path is provided, the cap 16 comprises a residual liquid absorption pad 48, attached to the cap 16 and more particularly to the inner casing 44. The pad 48 has a substantially annular shape and is arranged around the residual liquid expulsion shape 46. The expulsion shape 46 and the pad 48 as well as their mountings in the cap 16 are described in more detail in application WO2013/140069 published in the name of the applicant.

The invention is not limited to the embodiments described. In particular, it will be understood that an absorption pad alone can be provided, without necessarily providing on the inner casing 44 a protuberance having an expulsion shape 46. Moreover, we understand that the structural shapes of the means described may easily vary while fulfilling functions such as those described.

What is claimed is:

1. A liquid dispensing nozzle comprising:

a liquid dispensing opening, and a removable cap configured to cover the liquid dispensing opening, the removable cap comprising an outer casing and an inner casing that are coaxial, wherein the outer and inner casings are configured to move relative to each other in an axial direction of the nozzle between:

an unscrewing configuration wherein a pressing force applied to the removable cap is greater than a predetermined threshold, wherein a rotation in a first direction of the outer casing drives by friction a rotation of the inner casing in the same first direction, so as to be able to unscrew the cap, wherein the pressing force is different from a force required to rotate the cap in the first direction; and a safety configuration wherein a pressing force applied to the cap is lower than the predetermined threshold, wherein the outer casing is configured to freewheel relative to the inner casing in the first direction.

2. The nozzle according to claim 1, wherein, in a storage configuration, the outer casing and the inner casing each have a sealing surface and the sealing surfaces are in hermetic contact with each other.

3. The nozzle according to claim 2, wherein, in the safety configuration, the respective sealing surfaces of the outer casing and the inner casing are separated from each other to allow air to pass between them.

4. The nozzle according to claim 2, wherein the outer casing comprises a first locking device cooperating with a second complementary locking device carried by the inner casing so as to block the outer casing in rotation and in translation relative to the inner casing in the storage configuration.

5. The nozzle according to claim 4, wherein the inner casing is provided with a peripheral groove that receives the first locking device for locking in the safety configuration and unscrewing configuration, wherein the peripheral groove allows the first locking device to rotate freely in the peripherical groove.

6. The nozzle according to claim 4, wherein the first locking device comprises a gadroon and the second complementary locking device comprises a retaining housing, wherein the gadroon is received in the retaining housing.

7. The nozzle according to claim 1, wherein the outer casing comprises an actuation projection, and the inner casing comprises a guide surface that cooperates with the actuation projection such that:

in the safety configuration, a rotation of the outer casing in the first direction causes the actuation projection to slide on the guide surface causing the outer casing to turn freely relative to the inner casing, and in the unscrewing configuration, a rotation of the outer casing in the first direction drives a rotation of the inner casing in the first direction due to friction between the actuation projection and the guide surface the inner casing to unscrew the cap.

8. The nozzle according to claim 7, wherein the guide surface comprises a discontinuous camway which generates a tactile or audible indication when the actuation projection crosses the camway discontinuity in the safety configuration.

9. The nozzle according to claim 7, wherein the guide surface is carried by a guide slope and the inner casing comprises a flat area substantially perpendicular to the axial direction, a first end of the flat area being connected to one end of the guide slope and a second end of the flat area opposite the guide slope being provided with a lug forming a hard point.

10. The nozzle according to claim 7, wherein the inner casing comprises a skirt of substantially cylindrical shape and wherein the guide surface comprises at least two guide slopes extending from said skirt in the axial direction of the nozzle and being separated by notches.

11. The nozzle according to claim 7, wherein the actuation projection is provided with a screwing stop cooperating with a complementary screwing stop carried by the inner casing such that the inner casing and the outer casing are coupled in a rotational movement in a second direction opposite to the first direction, in order to screw the removable cap on the nozzle.

12. The nozzle according to claim 1, wherein the removable cap comprises a residual liquid absorption pad arranged adjacent the liquid dispensing opening.

13. The nozzle according to claim 1, wherein the removable cap comprises a protuberance configured to be adjacent to and opposite the liquid dispensing opening when the removable cap is mounted on the nozzle, the protuberance having a residual liquid expulsion shape, configured to evacuate a residual liquid from the liquid dispensing opening when the removable cap is mounted on the nozzle.

14. The nozzle according to claim 2, wherein a residual liquid evaporation path is arranged between the liquid dispensing opening and an outside of the nozzle, the residual liquid evaporation path being blocked in the storage configuration and opened in the safety configuration.

15. The nozzle according to claim 2, wherein the outer casing has a bottom with a sealing skirt that projects from an inner surface of the outer casing, the sealing skirt comprising the sealing surface of the outer casing and configured to be pressed hermetically against the sealing surface of the inner casing in the storage configuration, and to be separated from the sealing surface of the inner casing in the safety configuration.

16. The nozzle according to claim 1, wherein an outside surface of the outer casing is provided with tactile or visual means indicating to the user how to move from the safety configuration to the unscrewing configuration.

17. A liquid dispensing device comprising the liquid dispensing nozzle of claim 1 mounted on a container.

* * * * *